US009456286B2

(12) United States Patent
Kuhnel et al.

(10) Patent No.: US 9,456,286 B2
(45) Date of Patent: Sep. 27, 2016

(54) METHOD FOR OPERATING A BINAURAL HEARING SYSTEM AND BINAURAL HEARING SYSTEM

(71) Applicant: Phonak AG, Stafa (CH)

(72) Inventors: Volker Kuhnel, Mannedorf (CH); Ralph Peter Derleth, Hinwil (CH); Raphael Lamon, Feldmeilen (CH); Alexander Reich, Zurich (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 14/431,385

(22) PCT Filed: Sep. 28, 2012

(86) PCT No.: PCT/EP2012/069216

§ 371 (c)(1),
(2) Date: Mar. 26, 2015

(87) PCT Pub. No.: WO2014/048492

PCT Pub. Date: Apr. 3, 2014

(65) Prior Publication Data

US 2015/0249892 A1 Sep. 3, 2015

(51) Int. Cl.
*H04R 25/00* (2006.01)

(52) U.S. Cl.
CPC ..... *H04R 25/552* (2013.01); *H04R 25/407* (2013.01); *H04R 25/554* (2013.01); *H04R 2225/41* (2013.01)

(58) Field of Classification Search
CPC ..... H04R 25/60; H04R 25/65; H04R 25/70; H04R 25/356; H04R 25/453; H04R 25/502; H04R 25/505; H04R 25/554; H04R 25/604; H04R 25/652; H04R 25/658; H04R 2225/41; H04R 2225/43
USPC ..... 381/312–315, 317, 322, 328, 330
See application file for complete search history.

(56) References Cited

U.S. PATENT DOCUMENTS 8,295,497 B2 * 10/2012 Roeck ..... H04R 25/552 381/23
8,532,307 B2 * 9/2013 Derleth ..... 381/23.1

(Continued)

FOREIGN PATENT DOCUMENTS

EP 1 326 478 B1 7/2003
EP 1 339 256 A2 8/2003

(Continued)

OTHER PUBLICATIONS

International Search Report for PCT/EP2012/069216 dated Jul. 22, 2013.
Written Opinion for PCT/EP2012/069216 dated Jul. 22, 2013.

*Primary Examiner* — Brian Ensey
(74) *Attorney, Agent, or Firm* — Pearne & Gordon LLP

(57) ABSTRACT

The present invention proposes a method for operating a binaural hearing system with two hearing devices (1, 1') operationally interconnected by means of a bidirectional link (8) which improves hearing perception in windy listening situations. The method comprises determining the level of wind noise present at each of the two hearing devices (1, 1') and sending the audio signal picked-up at the first hearing device (1) to the second hearing device (1') via the link (8) and then providing an output signal derived from the received signal to the electrical-to-mechanical output converter (3') of the second hearing device (1') if the level of wind noise at the second hearing device (1') exceeds the level of wind noise at the first hearing device (1) by a pre-set threshold value. Furthermore, a binaural hearing system capable of performing such a method is given.

19 Claims, 3 Drawing Sheets

(56) References Cited

U.S. PATENT DOCUMENTS

2008/0306745 A1* 12/2008 Roy ..... G10L 19/008 704/500
2010/0002887 A1 1/2010 Roeck
2010/0135500 A1 6/2010 Derleth
2011/0249823 A1 10/2011 Thomsen

FOREIGN PATENT DOCUMENTS

EP 1 519 626 A2 3/2005
WO 99/43185 A1 8/1999

* cited by examiner

Situation: $WNL_1 > WNL_{1'}$; $\Delta WNL > Th_{min}$

METHOD FOR OPERATING A BINAURAL HEARING SYSTEM AND BINAURAL HEARING SYSTEM

TECHNICAL FIELD

The present invention relates to hearing devices, more specifically to binaural hearing systems comprising two hearing devices, one for each ear of a user. In particular the present invention pertains to a method for coping with wind noise in a binaural hearing system as well as to a binaural hearing system capable of performing such a method.

BACKGROUND OF THE INVENTION

Within the context of the present invention a hearing device is a miniature electronic device capable of stimulating a user's hearing and adapted to be worn at an ear or at least partly within an ear canal of a user. A pair of hearing devices, one intended to be worn at the left and the other at the right ear of a user, which are linked to one another is referred to as a binaural hearing system. The link between the two hearing devices of a binaural hearing system allows to bi-directionally exchange control and/or audio signals such as for instance exemplified in WO 99/43185 A1 and EP 1 326 478 A2. A primary application of hearing devices is to improve the hearing for hearing impaired users. In these cases the hearing devices are more specifically referred to as hearing instruments, hearing aids or hearing prostheses. Moreover, different styles of hearing devices exist in the form of behind-the-ear (BTE), in-the-ear (ITE), completely-in-canal (CIC) types, as well as hybrid designs consisting of an outside-the-ear part and an in-the-ear part, the latter typically including a receiver, i.e. a miniature loudspeaker, therefore commonly termed receiver-in-the-ear (RITE) or canal-receiver-technology (CRT) hearing devices. Depending on the severity and/or cause of the user's hearing loss, other electro-mechanical output transducers, such as a bone-anchored vibrator, a direct acoustic cochlear simulator (DACS) or cochlear implant (CI) are employed instead of a receiver. Other uses of hearing devices pertain to augmenting the hearing of normal hearing persons, for instance by means of noise suppression, to the provision of audio signals originating from remote sources, e.g. within the context of audio communication, and to hearing protection.

Hearing aids which amplify the ambient sound are sensitive to air flow turbulence at the microphone sound inlet port. This phenomenon is known as wind noise and generates high sound pressure levels at the system input, which translate into high output levels at the ear of the user. This wind noise masks useful signals such as speech and can be annoyingly loud. Current monaural techniques for dealing with this problem are only successful to a limited degree. Examples of monaural wind noise cancelling schemes are for instance disclosed in EP 1 339 256 A2 and EP 1 519 626 A2. They use frequency cues and/or correlation features between two microphone signals of a hearing device. A further implementation exploits features of a beamformed signal to detect wind noise. To counteract the wind noise the strength of a beamformer can be reduced and/or the frequency response of the output signal provided to the output transducer is modified appropriately, e.g. high-pass filtered. If the gain is reduced also the level of useful signals is lowered and perceived loudness is not kept at the desired level. If the beamformer is disabled spatial noise reduction is lost. Hence, monaural wind noise reduction techniques are oftentimes not effective. This is especially the case when employing a binaural hearing system.

SUMMARY OF THE INVENTION

It is an object of the present invention to propose a method for operating a binaural hearing system which improves hearing perception in windy listening situations. This object is achieved by the method according to claim 1.

It is a further object of the present invention to provide a binaural hearing system capable of performing such a proposed method. This further object is achieved by the system according to claim 12.

Various specific embodiments of the method and system according to the present invention are given in the dependent claims.

The present invention provides a method for operating a binaural hearing system comprising a first and a second hearing device operationally interconnected by means of a bidirectional link and each having a microphone arrangement and an electrical-to-mechanical output converter, the method comprising the steps of:

- capturing a first audio signal with the microphone arrangement of the first hearing device being worn at one ear of a user;
- capturing a second audio signal with the microphone arrangement of the second hearing device being worn at the other ear of the user;
- determining a level of a first wind noise based on the first audio signal;
- determining a level of a second wind noise based on the second audio signal;
- sending
  - an ancillary signal derived from the first audio signal from the first hearing device to the second hearing device if the level of the second wind noise exceeds the level of the first wind noise by a pre-set threshold value, or
  - an ancillary signal derived from the second audio signal from the second hearing device to the first hearing device if the level of the first wind noise exceeds the level of the second wind noise by the pre-set threshold value; and
- providing
  - a first output signal derived from the ancillary signal to the electrical-to-mechanical output converter of the first hearing device if the level of the first wind noise exceeds the level of the second wind noise by a pre-set threshold value, or
  - a first output signal derived from the ancillary signal to the electrical-to-mechanical output converter of the second hearing device if the level of the second wind noise exceeds the level of the first wind noise by a pre-set threshold value.

Typically, in a windy environment the effect of wind noise is strongly asymmetric. As a consequence, the user experiences a much stronger, i.e. louder wind noise at one ear compared to the other. The invention exploits this fact to mitigate the detrimental impact of wind noise on the hearing comfort of a user employing a binaural hearing system. This is achieved by sending the sound signal picked-up at the ear exposed to a lower level of wind noise to the hearing device located at the other ear, as soon as the difference in the level of wind noise between the two ears exceeds a pre-set threshold value. The sound signal received from the other ear can then be applied to the output transducer, e.g. a receiver, of the hearing device exposed to a higher level of wind noise, whereby for instance, the received sound signal is used to replace the sound signal picked-up by the microphone arrangement of this hearing device.

In an embodiment of the method the step of providing comprises providing:

a mixture of a first output signal derived from the ancillary signal and of a second output signal derived from the first audio signal to the electrical-to-mechanical output converter of the first hearing device if the level of the first wind noise exceeds the level of the second wind noise by a pre-set threshold value, or a mixture of a first output signal derived from the ancillary signal and of a second output signal derived from the second audio signal to the electrical-to-mechanical output converter of the second hearing device if the level of the second wind noise exceeds the level of the first wind noise by a pre-set threshold value, wherein low-pass filtering is applied to derive the ancillary signal and/or the first output signal, and wherein high-pass filtering is applied to derive the second output signal.

In this way the low-frequency range components of the sound signal picked-up by the hearing device exposed to a higher level of wind noise, which range is dominated by loud wind noise, is essentially replaced with the low-frequency range components of the sound signal picked-up by the hearing device at the other ear exposed to a lower level of wind noise, whilst the higher-frequency components are retained from the sound signal picked-up by the hearing device exposed to a higher level of wind noise, since they are hardly compromised by the wind noise, which is confined to the low-frequency range.

In a further embodiment of the method the cut-off frequency of the low-pass filtering is consistent with the cut-off frequency of the high-pass filtering, for instance both being selectable within the range between 1 kHz and 2 kHz, more particularly within the range between 1 kHz and 1.5 kHz, even more particularly within the range between 1 kHz and 1.2 kHz.

In a further embodiment of the method the cut-off frequency of the low-pass filtering and/or of the high-pass filtering and/or a maximum attenuation of the low-pass filtering and/or of the high-pass filtering are configured when fitting the binaural hearing system to the needs of the user. In this way the fitter, e.g. a hearing health care specialist such as an audiologist, can optimally set the filter parameters according to the specific needs of the user, especially taking into account his individual hearing loss. The cut-off frequency of the low-pass and high-pass filter (i.e. the transition frequency between ipsi- and contralateral signal) is then for example selected dependent on the used vent size and hence the low frequency hearing loss. As a rule, the more "open" the hearing devices are fitted in the ear canal, i.e. the more direct sound bypasses the hearing devices, the higher the cut-off frequency is chosen.

In a further embodiment of the method the cut-off frequency of the low-pass filtering and/or of the high-pass filtering and/or the maximum attenuation of the low-pass filtering and/or of the high-pass filtering are adjusted in dependence of the level of the first wind noise and/or the level of the second wind noise.

In a further embodiment of the method the first output signal and the second output signal are weighted in dependence of the level of the first wind noise and/or the level of the second wind noise. By applying a carefully selected mixing ratio of the ipsi-lateral sound signal and the sound signal received from the contralateral hearing device, for instance an optimal balance can be achieved between wind noise reduction and maintaining a binaural perception, i.e. a sense of sound directionality, by retaining spatial cues present in the low-frequency sound components. Otherwise, i.e. if the sound signal picked-up at one ear is provided to the ear-drums of both ears, it is difficult for the user to detect the direction of a sound source.

In a further embodiment of the method the level of the first wind noise and the level of the second wind noise are determined individually for different frequency sub-bands, thus yielding a plurality of sub-band levels of the first and second wind noise. In this way, it is possible to determine in which frequency sub-bands wind noise is dominant.

In a further embodiment of the method the ancillary signal is derived from selected frequency sub-bands of the first or second audio signal, respectively, dependent on either the sub-band levels of the first or second wind noise, respectively, or dependent on both the sub-band levels of the first and second wind noise. By doing so, for instance only those frequency components of the sound signal, which exhibit a certain difference in the sub-band level of the first or second wind noise, are sent to the other hearing device. In this way that bandwidth of the ancillary signal can be reduce, thus for instance requiring less power for wireless transmission of the ancillary signal.

In a further embodiment of the method the level of wind noise is sent from one hearing device to the other only if it exceeds a pre-defined minimum value, i.e. the level of the first wind noise is sent from the first hearing device to the second hearing device only if the level of the first wind noise exceeds a pre-defined minimum value, and vice-versa. In this way, usage of the link between the two hearing devices is reduced to those cases where a sufficient level of wind noise is present to justify applying the proposed form of binaural wind noise reduction. As a consequence, power required to operate the link is saved, and the power consumption of the overall binaural system is reduced.

In a further embodiment of the method the level of wind noise is sent to the other hearing device in response to receiving a level of wind noise from that hearing device, i.e. the level of the second wind noise is sent from the second hearing device to the first hearing device in response to receiving a level of the first wind noise from the first hearing device, and vice-versa. In this way, one hearing device takes on the role of a master, which triggers the other hearing device to send wind noise data upon receiving such data from the master hearing device.

In a further embodiment of the method determining the level of the first or second wind noise, respectively, is based on a signal from a single microphone of the first or second microphone arrangement, respectively, or on a beamformed signal derived from multiple microphones of the first or second microphone arrangement, respectively, or based on signals from both microphones of the first or second microphone arrangement.

In a further embodiment of the method a monaural wind noise reduction scheme is employed by the hearing device when sending the ancillary signal to the other hearing device.

In a further embodiment of the method a monaural wind noise reduction scheme is employed independently in the first and second hearing device when no ancillary signal is being sent from one hearing device to the other. In this way, monaural wind noise reduction is applied when the difference in the levels of wind noise between the two hearing devices is below a pre-set threshold, at which point sending an ancillary signal is not justified since it does not provide a sufficient benefit when applied at the other hearing device.

Such monaural wind noise reduction systems for instance apply a wind intensity steered variable high-pass filter and/or control (e.g. reduce) the strength (directionality) of the beamformer.

The present invention further provides a binaural hearing system comprising a first hearing device to be worn at one ear of a user and a second hearing device to be worn at the other ear of the user, the two hearing devices being operationally interconnectable by means of a bidirectional link and both comprising a microphone arrangement and an electrical-to-mechanical output converter, the system further comprising:

wind noise estimation means for determining a level of a first wind noise based on at least one output signal of the microphone arrangement of the first hearing device and for determining a level of a second wind noise based on at least one output signal of the microphone arrangement of the second hearing device; and controlling means configured to send an ancillary signal derived from the first audio signal from the first hearing device to the second hearing device via the link and providing a first output signal derived from the ancillary signal to the electrical-to-mechanical output converter of the first hearing device if the level of the first wind noise exceeds the level of the second wind noise by a pre-set threshold value, or an ancillary signal derived from the second audio signal from the second hearing device to the first hearing device via the link and providing a first output signal derived from the ancillary signal to the electrical-to-mechanical output converter of the second hearing device if the level of the second wind noise exceeds the level of the first wind noise by the pre-set threshold value.

In an embodiment the system further comprises:

combining means configured to provide a mixture of a first output signal derived from the ancillary signal and of a second output signal derived from the first audio signal to the electrical-to-mechanical output converter of the first hearing device if the level of the first wind noise exceeds the level of the second wind noise by a pre-set threshold value, or a mixture of a first output signal derived from the ancillary signal and of a second output signal derived from the second audio signal to the electrical-to-mechanical output converter of the second hearing device if the level of the second wind noise exceeds the level of the first wind noise by a pre-set threshold value;

at least one low-pass filter arranged to derive the ancillary signal and/or the first output signal; and a high-pass filter arranged to derive the second output signal.

In a further embodiment of the system the cut-off frequency of the at least one low-pass filter is consistent with the cut-off frequency of the high-pass filter, for instance both being selectable within the range between 1 kHz and 2 kHz, more particularly within the range between 1 kHz and 1.5 kHz, even more particularly within the range between 1 kHz and 1.2 kHz.

In a further embodiment of the system the cut-off frequency of the at least one low-pass filter and/or of the high-pass filter and/or a maximum attenuation of the at least one low-pass filter and/or of the high-pass filter are adapted to be adjustable in dependence of the level of the first wind noise and/or of the level of the second wind noise.

In a further embodiment the system further comprises weighting means for weighting the first output signal and the second output signal in dependence of the level of the first wind noise and/or of the level of the second wind noise.

In a further embodiment of the system the wind noise estimation means are configured to determine individually for different frequency sub-bands the level of the first and second wind noise, thus yielding a plurality of sub-band levels of the first and second wind noise.

In a further embodiment of the system the controlling means are configured to derive the ancillary signal from selected frequency sub-bands of the first or second audio signal, respectively, dependent on either the sub-band levels of the first or second wind noise, respectively, or dependent on both the sub-band levels of the first and second wind noise.

In a further embodiment of the system the controlling means are configured to send the level of the first wind noise from the first hearing device to the second hearing device only if the first wind noise exceeds a pre-defined minimum value.

In a further embodiment of the system the controlling means are configured to send the level of the second wind noise from the second hearing device to the first hearing device in response to receiving a level of the first wind noise from the first hearing device.

In a further embodiment of the system the wind noise estimation means are configured to determine the level of first or second wind noise, respectively, based on a signal from a single microphone of the first or second microphone arrangement, respectively, or on a beamformed signal derived from multiple microphones of the first or second microphone arrangement, respectively.

In a further embodiment of the system the controlling means are configured to employ a monaural wind noise reduction scheme in the first or second hearing device when sending the ancillary signal to the other hearing device.

In a further embodiment of the system the controlling means are configured to employ a monaural wind noise reduction scheme independently in the first and second hearing devices if no ancillary signal is being sent from one hearing device to the other.

It is pointed out that combinations of the above-mentioned embodiments give rise to even further, more specific embodiments according to the present invention.

BRIEF DESCRIPTION OF THE DRAWINGS

The present invention is further explained below by means of non-limiting specific embodiments and with reference to the accompanying drawings, which show.

In the figures, like reference signs refer to like parts or components.

DETAILED DESCRIPTION OF THE INVENTION

Figure 1:
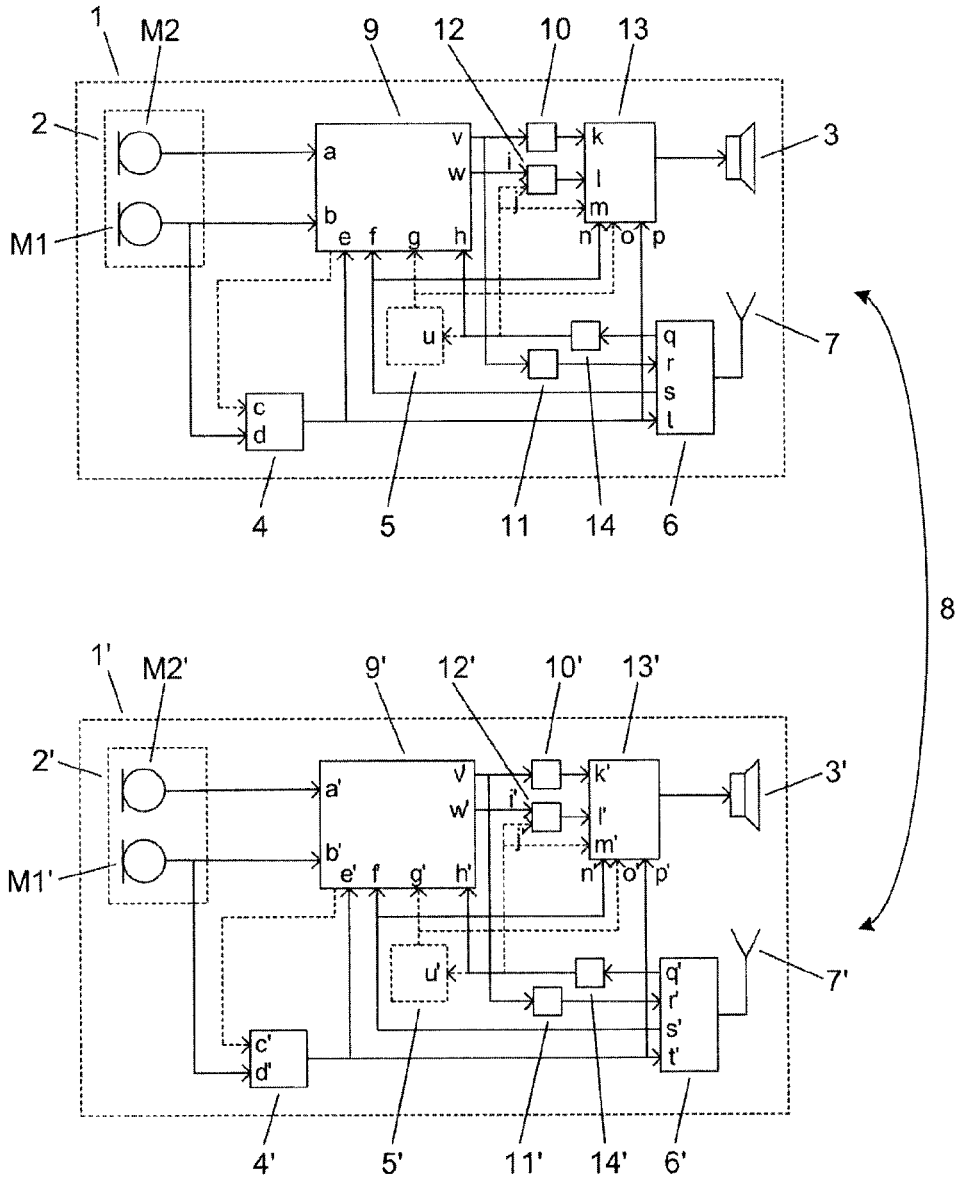
FIG. 1 a schematic illustration of an exemplary embodiment of a binaural hearing system according to the present invention (including optional and alternative components)

A basic embodiment of the present invention will now be described with the aid of the schematic illustration presented in FIG. 1. FIG. 1 depicts a high-level block diagram of a binaural hearing system consisting of a first hearing device 1 and a second hearing device 1' which are interconnected by means of a bidirectional link 8 (also referred to as binaural link). This link commonly is realised as a wireless link, for instance an inductive link or a radio frequency link, but may also be implemented as a wire-bound link or by employing the skin as a conductor. In FIG. 1 the first and second hearing devices 1, 1' communicate wirelessly using the transceivers 6, 6' together with the associated antennas 7, 7'. Audio signals (digital or analogue) as well as control data can be exchanged utilising different bandwidths between the two hearing devices 1, 1' via this link 8. Ambient sound is picked-up separately by each of the first and second hearing devices 1 and 1' with the corresponding microphone arrangements 2 and 2'. Commonly used microphone arrangements 2, 2' comprise a microphone pair M1, M2 and M1', M2'. The signal for example from the microphone M1, M1' is applied to a wind noise estimation unit 4, 4' in order to determine the wind noise levels $WNL_1$, $WNL_{1'}$ present at the first and second hearing devices 1, 1'. Wind noise estimation can for instance be based on the amount of low frequency energy detected in the signal from the microphone M1, M1', or alternatively using a Bayesian statistical estimation scheme, where the probability ratio between the probability that there is wind and the probability of a windless condition is computed. For the latter purpose, it is assumed that both conditions (i.e. wind vs. no wind) arise with a Gaussian probability distribution having the same variance but different mean values. Both training data and fine tuning are used to estimate beforehand the variance and the two mean values in order to achieve an appropriate estimation of the wind noise level. Alternatively, the signals from both microphones M1, M2 and M1', M2' can first be provided to the central processing unit (CPU) 9, 9' (via the inputs a, b & a', b') where beamforming is applied resulting in a single beamformed signal (at output e & e'). This beamformed signal is then applied to the wind noise estimation unit 4, 4' in order to determine the wind noise levels $WNL_1$, $WNL_{1'}$ present at the first and second hearing devices 1, 1'. As a further alternative, the omnidirectional signal for example from the microphone M1, M1' as well as the beamformed signal are both applied to the wind noise estimation unit 4, 4', which then determines the coherence between the two, thus yielding a measure of the wind noise level. The determined wind noise level $WNL_1$ is then sent to from the first hearing device 1 to the second hearing device 1' (from input t to input f'), and vice-versa for $WNL_{1'}$ (from input t' to input f). The two wind noise levels $WNL_1$ and $WNL_{1'}$ are subsequently compared with each other in the CPU 9, 9'. If for instance $WNL_{1'}$ exceeds $WNL_1$ by more than a pre-set threshold value $Th_{min}$ the sound signal picked-up by the microphone arrangement 2 of the first hearing device 1 is sent from the first hearing device 1 (from output v via input r via output q via input m) to the receiver 3' of the second hearing device 1', where it is output instead of the sound signal picked-up by the microphone arrangement 2' of the second hearing device 1' (under suitable control of the combining unit 9'). At the same time the sound signal picked-up by the microphone arrangement 2 of the first hearing device 1 is provided by the CPU 9 at output v and applied to the receiver 3.

Alternatively, control of this mechanism can be centralised in only one of the hearing devices 1, 1', which determines both wind noise levels $WNL_1$, $WNL_{1'}$, for instance by sending the sound signal picked-up by the microphone arrangement 2' of the second hearing device 1' (e.g. via output v' and input r') from the second hearing device 1' to the first hearing device 1 via the link 8 and determining the wind noise level $WNL_{1'}$ using the alternate wind noise estimation unit 5 (or instead by sharing the wind noise estimation unit 4 to also do this). In case $WNL_1$ exceeds $WNL_{1'}$ by more than the pre-set threshold $Th_{min}$ the first hearing device 1 provides the signal received from the second hearing device 1' to the receiver 3 instead of the sound signal picked-up by the microphone arrangement 2. On the other hand, if $WNL_{1'}$ exceeds $WNL_1$ by more than the pre-set threshold $Th_{min}$ the first hearing device 1 sends the sound signal picked-up by the microphone arrangement 2 via the link 8 to the second hearing device 1' where it is applied to the receiver 3' in place of the sound signal picked-up by the microphone arrangement 2'.

Further alternatives are conceivable. For instance the signal received via the link 8 from the other hearing device 1, 1' can first be applied to the CPU 9, 9' (via input h, h') and then processed therein before being output to the receiver 3, 3'. The processing within the CPU can comprise applying a gain model dependent on the hearing loss of the ear to which the corresponding hearing device 1, 1' is associated. As another example the signal from the microphone arrangement 2, 2' of one hearing device 1, 1' can be combined with the signal received from the other hearing device 1', 1 in the CPU 9, 9' before applying the above mentioned signal processing (e.g. frequency-depend gain) to the combined signal, which is then output to the receiver 3, 3'. This has the advantage over the previously described procedure, that the signal processing performed in the CPU 9, 9' only needs to be applied once to the combined signal instead of twice, in parallel to both the signal from the microphone arrangement 2, 2' of the one hearing device 1, 1' as well as to the signal received from the other hearing device 1', 1.

Optionally, a certain delay (typically 0.5 to 5 ms) can be applied to the ancillary signal by introducing a delay element 14, 14' into the signal path in order to exploit the lateralisation ability of the human binaural hearing (precedence effect). The delay can be adjusted (and is for instance predetermined during fitting of the binaural hearing system) so as to achieve the individually desired strength of lateralisation.

Alternatively, the signal supplied to the receiver 3, 3' of the hearing device 1, 1' (i.e. the ipsi-lateral one) where the wind noise level exceeds the wind noise level present at the other (i.e. the contralateral) hearing device 1', 1 can be a mixture (i.e. a combination) of both the sound signal received from the contralateral hearing device 1', 1 via the link 8 (via output q, q') and the sound signal picked-up by the microphone arrangement 2, 2' of the ipsi-lateral hearing device 1, 1' (via output v, v'). This mixing of the sound signals is performed by the combining unit 13, 13'.

Prior to combining the sound signal picked-up by the microphone arrangement 2, 2' of the ipsi-lateral hearing device 1, 1' can be filtered with the high-pass filter 10, 10', and the signal received from the contralateral hearing device 1', 1 can be filtered with the low-pass filter 12, 12'. Alternatively (or additionally) the signal sent from the contralateral hearing device 1', 1 to the ipsi-lateral hearing device 1, 1' can be filtered prior to transmission by the low-pass filter 11', 11 located in the contralateral hearing device 1', 1.

Figure 2:
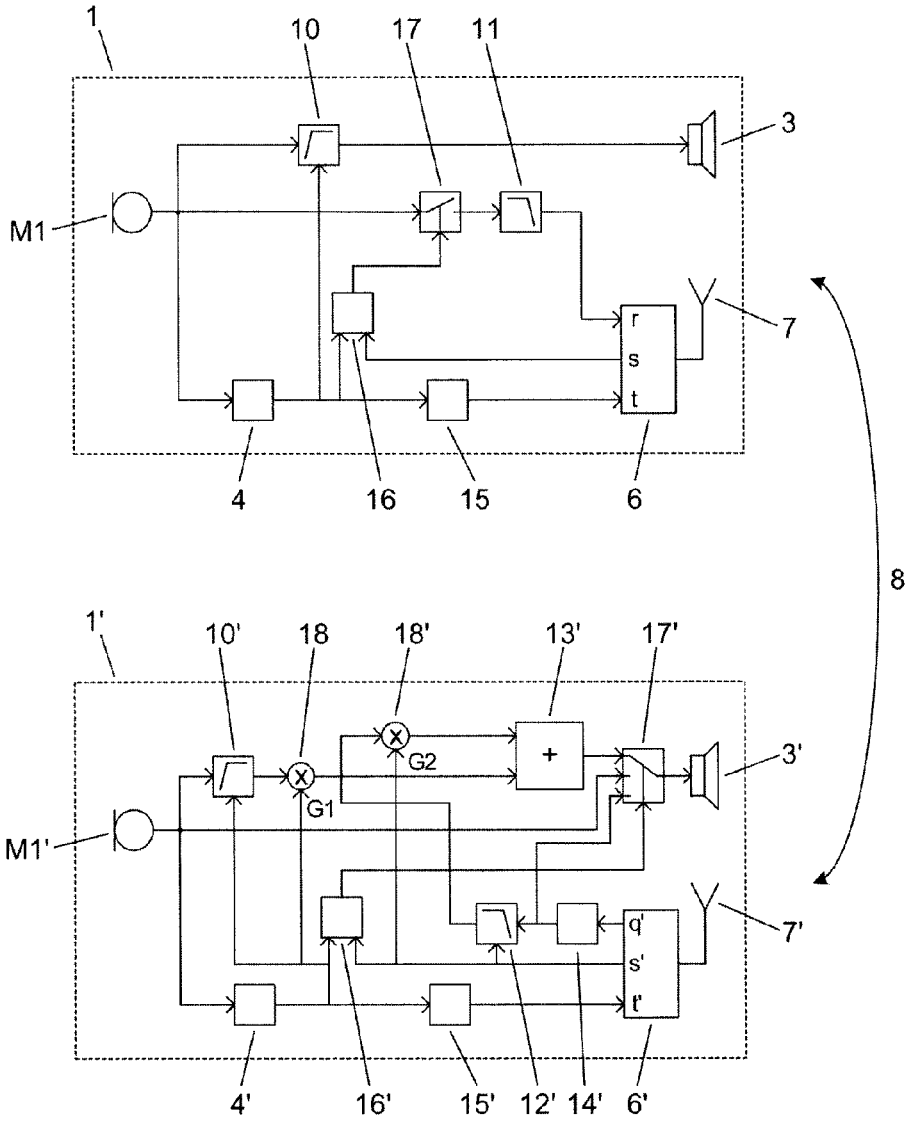
FIG. 2 a schematic illustration of an exemplary embodiment of a binaural hearing system according to the present invention (including optional and alternative components) adapted to a specific wind noise situation.
Figure 3:
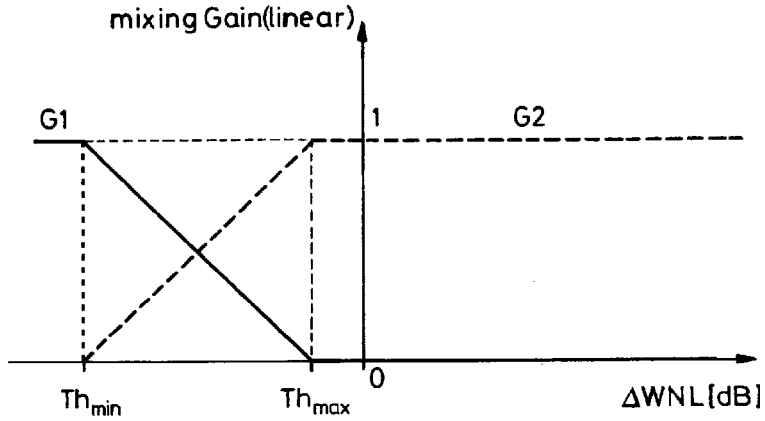
FIG. 3 plots of exemplary gain functions applied in the weighting means.

The combining process is now further explained with reference to FIG. 2 which specifically depicted a block diagram showing those blocks operational in the first and second hearing device 1 and 1' for the situation where the wind noise level is greater by the pre-set threshold $Th_{min}$ at the second hearing device 1' so that the sound signal picked-up by the first hearing device 1 is sent via the link 8 to the second hearing device 1'. At the same time, the sound signal picked-up by the first hearing device 1 is applied to a high-pass filter 10, in order to provide monaural wind noise reduction and subsequently output via the receiver 3. As can be seen in FIG. 2 the wind noise level $WNL_1$ determined by the wind noise estimation unit 4 is provided to one input of a comparator 16, whilst the other wind noise level $WNL_{1'}$ determined by the wind noise estimation unit 4' and received from the second hearing device 1' via the link 8 is provided to the other input of a comparator 16. The comparator 16 determines that the wind noise level $WNL_{1'}$ at the second hearing device 1' exceeds the wind noise level $WNL_1$ present at the first hearing device by the pre-set threshold $Th_{min}$, and therefore activates the switch 17 to enable sending the sound signal picked-up by the microphone M1 to the second hearing device 1'. Thereby, the sound signal can optionally be filtered by the low-pass filter 11 prior to transmission in order to reduce the bandwidth required to send the sound signal. At the second hearing device 1' the output signal provided by the comparator 16', which is also provided with the two wind noise levels $WNL_{1'}$ and $WNL_{1'}$ at its input, is used to control the switch 17' allowing to select which signal is to be output by the receiver 3'. In the present case this could be either the sound signal received directly from the first hearing device 1, or a mixture of the received signal and the sound signal picked-up by the microphone M1'. The latter mixture is generated by adding these two signals in the combiner unit 13'. Prior to combining the two signals they are each weighted for instance dependent on the wind noise level associated with the respective signal. This is achieved by means of the weighting units 18, 18' providing gains G1, G2 for example proportional to the wind noise levels $WNL_1$ and $WNL_{1'}$. Exemplary weighting functions G1(ΔWNL), G2(ΔWNL) are depicted in FIG. 3. As can be seen in this example the gain G2 applied to the signal from the contralateral hearing device linearly increases as soon as the difference in wind noise level (ΔWNL) exceeds the pre-set threshold, i.e. the minimal threshold, until it reaches the maximum threshold $Th_{max}$ beyond which it remains at a constant value of one. Conversely, the gain G1 applied to the signal picked-up by the ipsi-lateral hearing device linearly decreases from a constant value of one once the difference in wind noise level (ΔWNL) exceeds the pre-set threshold, i.e. the minimum threshold, until it reaches the maximum threshold $Th_{max}$ beyond which it is disregarded (i.e. gain equals zero).

Figure 4:
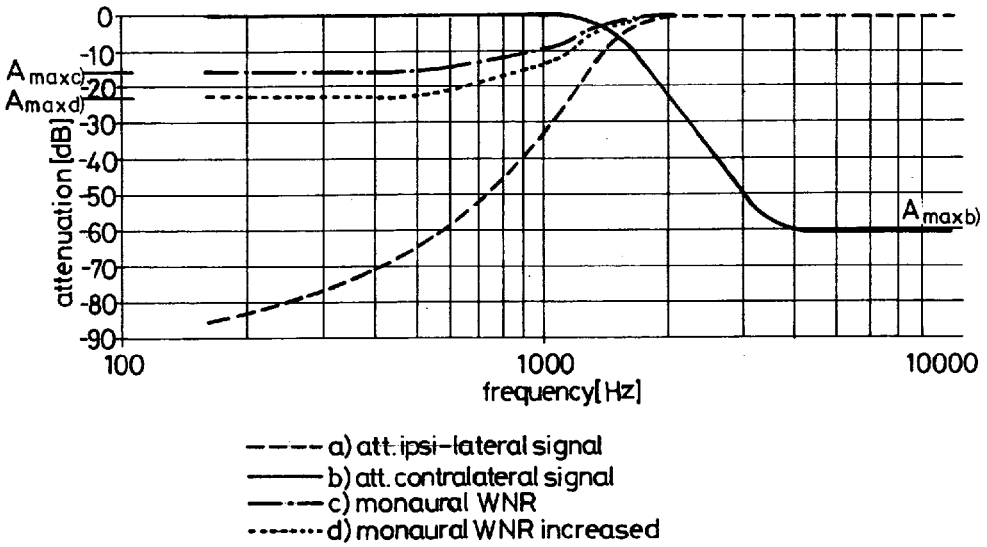
FIG. 4 plots of exemplary high-pass and low-pass filter transfer functions applied to the two signals provided to electrical-to-mechanical output converter.

Prior to this weighting the sound signal from the microphone M1' is filtering with the high-pass filter 10', and the received signal is filtering with the low-pass filter 12'. Exemplary transfer functions of these filters are shown in FIG. 4. Plot a) depicts a possible high-pass filter transfer characteristic applied to the signal picked-up by the ipsi-lateral hearing device. Plot b) depicts a possible low-pass filter transfer characteristic applied to the signal received from the contralateral hearing device. Plot c) depicts a possible high-pass filter transfer characteristic applied to the signal picked-up by the contralateral hearing device, providing monaural wind noise reduction. Furthermore, plot d) depicts another possible high-pass filter transfer characteristic with an increased maximum attenuation $A_{max}$ applied to the signal picked-up by the contralateral hearing device, again providing monaural wind noise reduction.

The cut-off frequency of the low-pass filter 12' and of the high-pass filter 10' as well as the maximum attenuation $A_{max}$ of these two filters may also be adjusted in dependence of the level of the first wind noise $WNL_1$ and/or the level of the second wind noise $WNL_{1'}$. This allows to further optimise the combined signal applied to the receiver 3'. The received signal can be delayed by means of the delay element 14' in order to achieve a certain lateralisation, such that directional hearing is maintained.

In order to minimise usage of the binaural link when little or no wind noise is present at both hearing devices 1, 1', the determined wind noise level is only sent to the contralateral hearing device if it is above a pre-defined minimum value. This is achieved by means of the threshold detector 15, 15'. Thus, an advantage of the present invention is that the binaural link 8 is activated for communicating wind noise data only when a substantial level of wind noise (>the pre-defined minimum value) is present at either of the hearing devices 1, 1'. Moreover, only when a significant difference (>$Th_{min}$) in the level of wind noise present at the two hearing devices 1, 1' is detected is the binaural link 8 used to transmit a sound signal requiring a higher bandwidth compared to sending just wind noise data. Hence the power consuming link 8 is only seldom operated with a high bandwidth, thus minimising the battery drain caused by the binaural link 8 of the binaural hearing system.

The presented method according to the present invention can also be applied in combination with known monaural wind noise reduction techniques, for instance by further combining the signal obtained by conventional monaural wind noise reduction processing with the signal obtained at the output of the combining unit 13 according to the proposed "binaural" wind noise reduction method according to the present invention. Again the mixing of these two signal (i.e. the one obtained from the monaural wind noise reduction processing with the one obtained from binaural wind noise reduction processing) can be made dependent on the two wind noise levels $WNL_1$ and/or $WNL_{1'}$.

User benefits of the present invention include:

- generally less annoyance from wind noise;
- better speech intelligibility in windy situations;
- improved speech understanding in listening situations with asymmetric speech and wind direction; and
- provision of a significantly better loudness impression than achievable with typical state of the art wind noise reduction systems.

What is claimed is:

1. A method for operating a binaural hearing system comprising a first and a second hearing device (1, 1') operationally interconnected by means of a bidirectional link (8) and each having a microphone arrangement (2, 2') and an electrical-to-mechanical output converter (3, 3'), the method comprising the steps of:

- capturing a first audio signal with the microphone arrangement (2) of the first hearing device (1) being worn at one ear of a user;
- capturing a second audio signal with the microphone arrangement (2') of the second hearing device (1') being worn at the other ear of the user;
- determining a level of a first wind noise based on the first audio signal;
- determining a level of a second wind noise based on the second audio signal;

sending an ancillary signal derived from the first audio signal from the first hearing device (1) to the second hearing device (1') if the level of the second wind noise exceeds the level of the first wind noise by a pre-set threshold value ($Th_{min}$), or an ancillary signal derived from the second audio signal from the second hearing device (1') to the first hearing device (1) if the level of the first wind noise exceeds the level of the second wind noise by the pre-set threshold value ($Th_{min}$); and providing a mixture of a first output signal derived from the ancillary signal and of a second output signal derived from the first audio signal to the electrical-to-mechanical output converter (3) of the first hearing device (1) if the level of the first wind noise exceeds the level of the second wind noise by a pre-set threshold value ($Th_{min}$), or a mixture of a first output signal derived from the ancillary signal and of a second output signal derived from the second audio signal to the electrical-to-mechanical output converter (3') of the second hearing device (1') if the level of the second wind noise exceeds the level of the first wind noise by a pre-set threshold value ($Th_{min}$), wherein low-pass filtering is applied to derive the ancillary signal and/or the first output signal, and wherein high-pass filtering is applied to derive the second output signal.

2. The method of claim 1, wherein the cut-off frequency of the low-pass filtering is consistent with the cut-off frequency of the high-pass filtering, for instance both being selectable within the range between 1 kHz and 2 kHz, more particularly within the range between 1 kHz and 1.5 kHz, even more particularly within the range between 1 kHz and 1.2 kHz.

3. The method of claim 2, wherein the cut-off frequency of the low-pass filtering and/or of the high-pass filtering and/or a maximum attenuation ($A_{max}$) of the low-pass filtering and/or of the high-pass filtering are configured when fitting the binaural hearing system to the needs of the user.

4. The method of claim 1, wherein the cut-off frequency of the low-pass filtering and/or of the high-pass filtering and/or a maximum attenuation ($A_{max}$) of the low-pass filtering and/or of the high-pass filtering are adjusted in dependence of the level of the first wind noise and/or the level of the second wind noise.

5. The method of claim 1, wherein the first output signal and the second output signal are weighted in dependence of the level of the first wind noise and/or the level of the second wind noise.

6. The method of claim 1, wherein the level of the first wind noise and the level of the second wind noise are determined individually for different frequency sub-bands, thus yielding a plurality of sub-band levels of the first and second wind noise.

7. The method of claim 6, wherein the ancillary signal is derived from selected frequency sub-bands of the first or second audio signal, respectively, dependent on either the sub-band levels of the first or second wind noise, respectively, or dependent on both the sub-band levels of the first and second wind noise.

8. The method of claim 1, wherein the level of the first wind noise is sent from the first hearing device (1) to the second hearing device (2) only if the level of the first wind noise exceeds a pre-defined minimum value.

9. The method of claim 1, wherein determining the level of the first or second wind noise, respectively, is based on a signal from a single microphone (M1, M1') of the first or second microphone arrangement (2, 2'), respectively, or on a beamformed signal derived from multiple microphones (M1, M2; M1', M2') of the first or second microphone arrangement (2, 2'), respectively.

10. The method of claim 1, wherein a monaural wind noise reduction scheme is employed by the first and/or second hearing device (1, 1') when not receiving the ancillary signal from the other hearing device (1', 1).

11. A binaural hearing system comprising a first hearing device (1) to be worn at one ear of a user and a second hearing device (1') to be worn at the other ear of the user, the two hearing devices (1, 1') being operationally interconnectable by means of a bidirectional link (8) and both comprising a microphone arrangement (2, 2') and an electrical-to-mechanical output converter (3, 3'), the system further comprising:

wind noise estimation means (4, 4', 5, 5') for determining a level of a first wind noise based on an output signal of the microphone arrangement (2) of the first hearing device (1) and for determining a level of a second wind noise based on an output signal of the microphone arrangement (2') of the second hearing device (1'); and controlling means configured to send an ancillary signal derived from the first audio signal from the first hearing device (1) to the second hearing device (1') via the link (8) and providing a first output signal derived from the ancillary signal to the electrical-to-mechanical output converter (3) of the first hearing device (1) if the level of the first wind noise exceeds the level of the second wind noise by a pre-set threshold value ($Th_{min}$), or an ancillary signal derived from the second audio signal from the second hearing device (1') to the first hearing device (1) via the link (8) and providing a first output signal derived from the ancillary signal to the electrical-to-mechanical output converter (3') of the second hearing device (1') if the level of the second wind noise exceeds the level of the first wind noise by the pre-set threshold value ($Th_{min}$);

combining means (13, 13') configured to provide a mixture of a first output signal derived from the ancillary signal and of a second output signal derived from the first audio signal to the electrical-to-mechanical output converter (3) of the first hearing device (1) if the level of the first wind noise exceeds the level of the second wind noise by a pre-set threshold value ($Th_{min}$), or a mixture of a first output signal derived from the ancillary signal and of a second output signal derived from the second audio signal to the electrical-to-mechanical output converter (3') of the second hearing device (1') if the level of the second wind noise exceeds the level of the first wind noise by a pre-set threshold value ($Th_{min}$);

at least one low-pass filter (11, 11', 12, 12') arranged to derive ancillary signal and/or the first output signal; and a high-pass (10, 10') filter arranged to derive the second output signal.

12. The system of claim 11, wherein the cut-off frequency of the at least one low-pass filter (11, 11', 12, 12') is consistent with the cut-off frequency of the high-pass filter (10, 10'), for instance both being selectable within the range between 1 kHz and 2 kHz, more particularly within the range between 1 kHz and 1.5 kHz, even more particularly within the range between 1 kHz and 1.2 kHz.

13. The system of claim 11, wherein the cut-off frequency of the at least one low-pass filter (11, 11', 12, 12') and/or of the high-pass filter (10, 10') and/or a maximum attenuation ($A_{max}$) of the at least one low-pass filter (11, 11', 12, 12') and/or of the high-pass filter (10, 10') are adapted to be adjustable in dependence of the level of the first wind noise and/or of the level of the second wind noise.

14. The system of claim 11, further comprising weighting means (18, 18') for weighting the first output signal and the second output signal in dependence of the level of the first wind noise and/or of the level of the second wind noise.

15. The system of claim 11, wherein the wind noise estimation means (4, 4', 5, 5') are configured to determine individually for different frequency sub-bands the level of the first and second wind noise, thus yielding a plurality of sub-band levels of the first and second wind noise.

16. The system of claim 11, wherein the controlling means are configured to derive the ancillary signal from selected frequency sub-bands of the first or second audio signal, respectively, dependent on either the sub-band levels of the first or second wind noise, respectively, or dependent on both the sub-band levels of the first and second wind noise.

17. The system of claim 11, wherein the controlling means (15) are configured to send the level of the first wind noise from the first hearing device to the second hearing device only if the first wind noise exceeds a pre-defined minimum value.

18. The system of claim 11, wherein the wind noise estimation means (4, 4', 5, 5') are configured to determine the level of first or second wind noise, respectively, based on a signal from a single microphone of the first or second microphone arrangement, respectively, or on a beamformed signal derived from multiple microphones of the first or second microphone arrangement, respectively.

19. The system of claim 11, wherein the controlling means are configured to employ a monaural wind noise reduction scheme in the first and/or second hearing device (1, 1') when not receiving the ancillary signal from the other hearing device (1', 1).

* * * * *